US007563219B2

(12) United States Patent
Owen et al.

(10) Patent No.: US 7,563,219 B2
(45) Date of Patent: Jul. 21, 2009

(54) DUAL DRUM CONFIGURATION FOR TRANSVERSE DIRECTION APPLICATION OF ZIPPERS

(75) Inventors: Kevin Owen, Flowery Branch, GA (US); David C. Wallace, Lilburn, GA (US)

(73) Assignee: Illinois Tool Works Inc., Glenview, IL (US)

( * ) Notice: Subject to any disclaimer, the term of this patent is extended or adjusted under 35 U.S.C. 154(b) by 77 days.

(21) Appl. No.: 11/799,597

(22) Filed: May 2, 2007

(65) Prior Publication Data

US 2008/0271415 A1 Nov. 6, 2008

(51) Int. Cl.
*B31B 19/90* (2006.01)
*B65B 61/18* (2006.01)

(52) U.S. Cl. ..... 493/213; 53/133.4; 53/139.2; 156/66; 493/927

(58) Field of Classification Search ..... 53/412, 53/133.4, 139.2; 493/212–214, 927; 156/66; *B31B 19/90; B65B 61/18*

See application file for complete search history.

(56) References Cited

U.S. PATENT DOCUMENTS

| | | | | |
|---|---|---|---|---|
| 4,655,862 | A * | 4/1987 | Christoff et al. | 493/927 |
| 4,878,987 | A | 11/1989 | Ven Erden | |
| 5,776,045 | A * | 7/1998 | Bodolay et al. | 53/133.4 |
| 5,816,018 | A * | 10/1998 | Bois | 53/133.4 |
| 6,003,582 | A * | 12/1999 | Blohowiak et al. | 493/213 |
| 6,620,087 | B1 * | 9/2003 | Plourde | 493/213 |
| 6,726,612 | B1 * | 4/2004 | Bodolay | 493/213 |
| 6,941,726 | B2 * | 9/2005 | Ausnit | 493/927 |

FOREIGN PATENT DOCUMENTS

| | | | |
|---|---|---|---|
| DE | 88 03 021 | U1 | 6/1988 |
| EP | 0282723 | A2 * | 9/1988 |
| EP | 1 186 404 | A | 3/2002 |
| WO | WO 03/097341 | A1 * | 11/2003 |

* cited by examiner

*Primary Examiner*—Stephen F Gerrity
(74) *Attorney, Agent, or Firm*—Day Pitney LLP

(57) ABSTRACT

A drum configuration uses first and second rotary drums to apply alternate zipper segments in a transverse direction to a sheet of moving web or film. This allows the web to maintain a constant speed without the intermittent pausing while the zipper segments are sealed to the web.

19 Claims, 3 Drawing Sheets

DUAL DRUM CONFIGURATION FOR TRANSVERSE DIRECTION APPLICATION OF ZIPPERS

BACKGROUND OF THE INVENTION

1. Field of the Invention

The present invention relates to a dual drum configuration for applying zippers in the transverse direction to a moving film or web. This is particularly applicable to the manufacture of reclosable packages or bags, such as in form-fill-and-seal (EFS) methods.

2. Description of the Prior Art

In the prior art, it is known to seal zipper segments in a transverse direction to a web or film of polymeric material. A transverse applicator including multiple wheels (or a vacuum plate) and a track plate may be used. Alternately, a single drum is used to place and seal the zipper segment to the web or film. However, in this configuration, the web or film is typically momentarily or intermittently stopped in order to seal the zipper to the web or film. This slows the production rate of the apparatus and further decreases the reliability of apparatus, as well as contributing to increased wear and vibration on the apparatus.

OBJECTS AND SUMMARY OF THE INVENTION

It is therefore an object of the present invention to increase the production rate and reliability of an apparatus for sealing of zippers in a transverse direction to a moving film or web.

It is therefore a still further object of the present invention to provide for sealing of zippers in a transverse direction to a moving film or web while maintaining a continuous motion of the film or web.

These and other objects are attained by providing a dual rotary drum configuration, wherein the rotary drums are spaced apart from each other in the machine direction of the moving web or film. Zipper segments are fed into the rotary drums and the rotary drums rotate into position for sealing the zipper segments in a transverse configuration to the moving film or web. The rotary drums are programmed so as to be synchronized whereby the first rotary drum rotates with a matched speed of the film or web during sealing while the second rotary drum is receiving and positioning the next zipper to be sealed.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
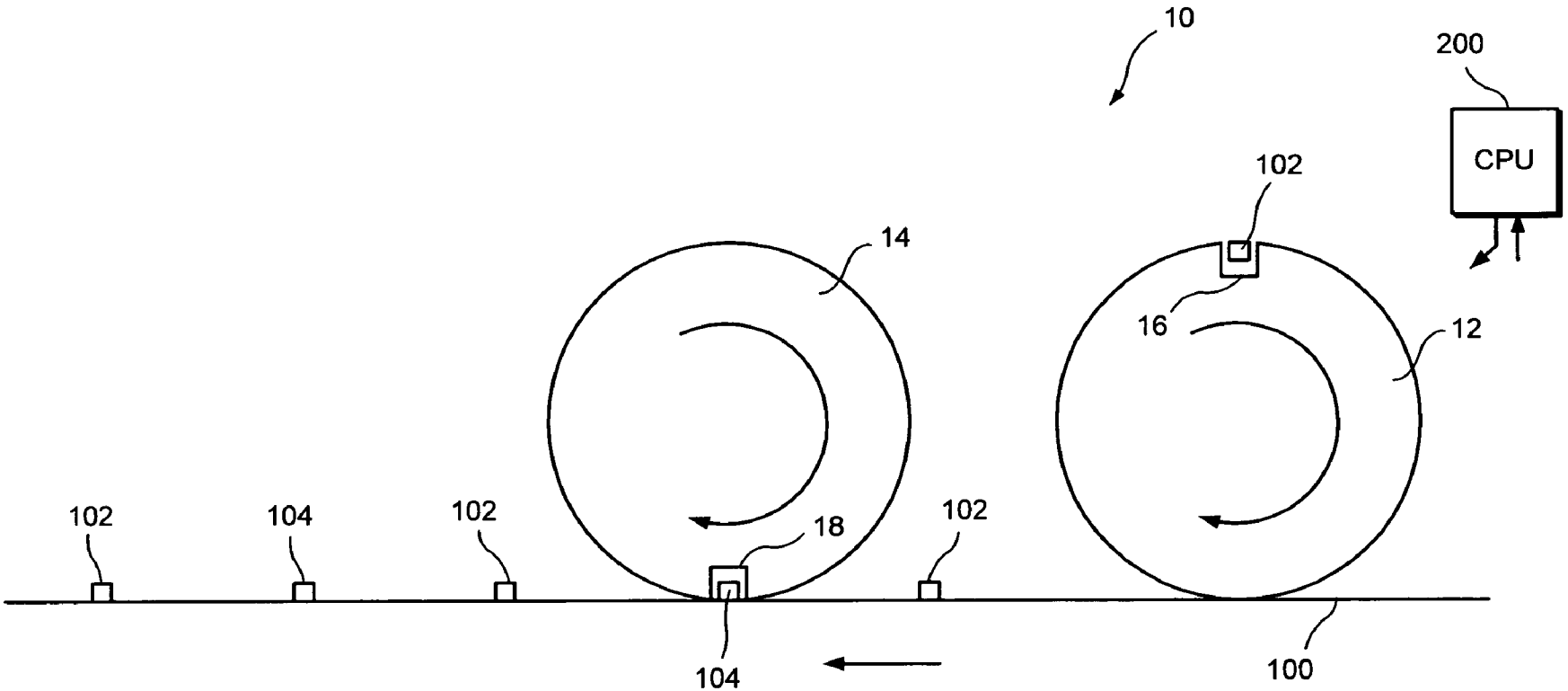
FIG. 1 is a side plan view of the rotary drum configuration of the present invention, further showing the moving film or web and transverse zipper segments.
Figure 2:
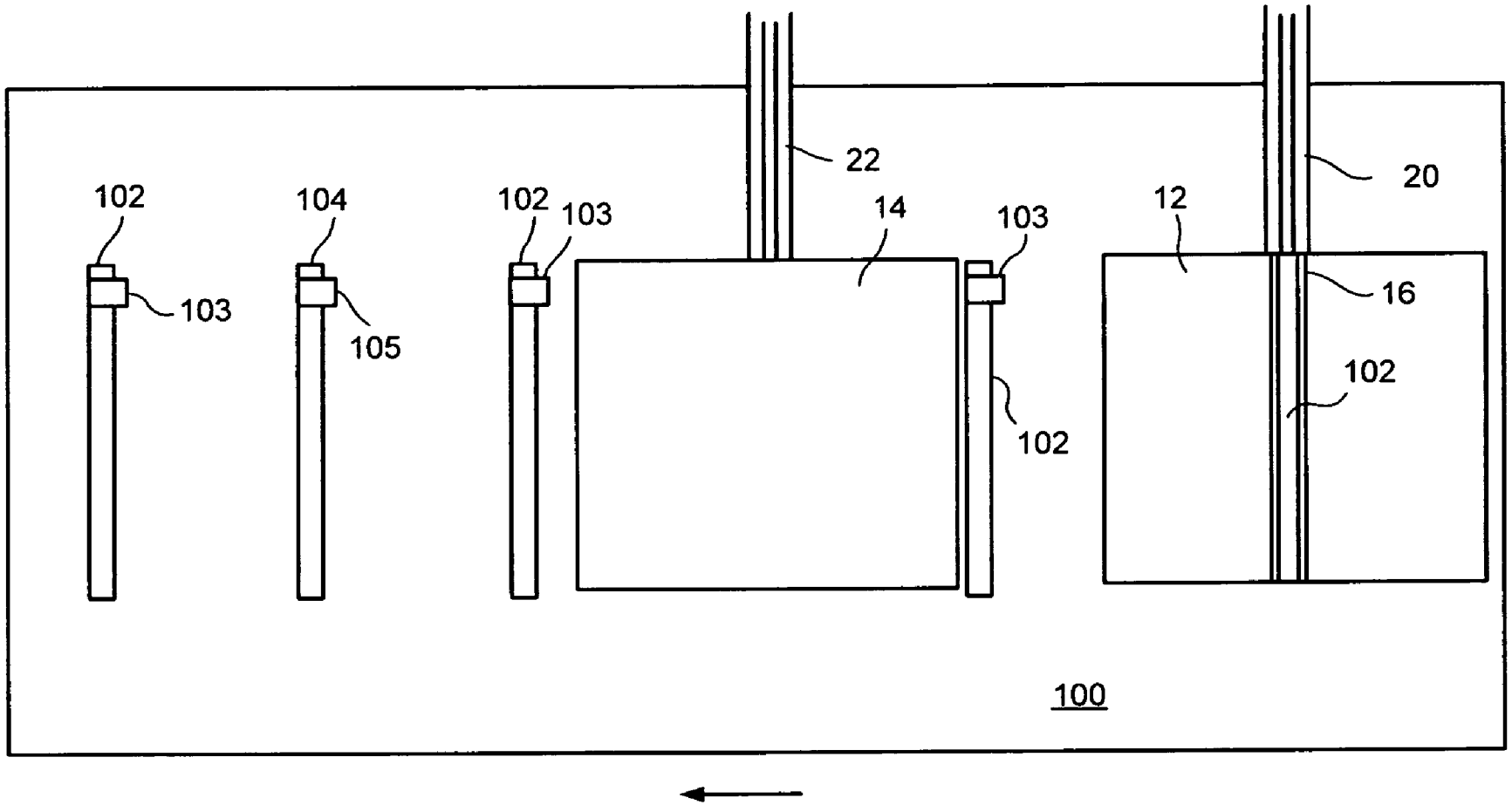
FIG. 2 is a top plan view of the rotary drum configuration of the present invention, further showing the moving film or web and transverse zipper segments.

Referring now to the drawings in detail wherein like numerals indicate like elements throughout the several views, one sees that FIG. 1 is a side plan view of the rotary drum configuration 10 of the present invention, while FIG. 2 is a top plan view thereof. Rotary drum configuration 10 includes first rotary drum 12 and second rotary drum 14. Rotary drums 12, 14 rotate in the clockwise direction (in the configuration and orientation of FIG. 1) in synchronization with web 100 which moves to the left.

First and second rotary drums 12, 14 include respective first and second longitudinal zipper notches 16, 18 which receive respective zipper segments 102, 104 from respective first and second zipper sources 20, 22. First and second zipper sources 20, 22 typically cut the zipper segments from continuous lengths of zipper material prior to loading and may include a slider mounting device (not shown). The zipper segments 102, 104 (with respective optional mounted sliders 103, 105 which operate to separate the profiles of the zipper segment when moved in a first direction and interlock the profiles of the zipper segment when moved in a second direction) are received when the respective zipper notches 16, 18 are at the uppermost position (see first rotary drum 12). The rotary drums 12, 14 then rotate to position the zipper segments 102, 104 against web 100 and seal the zipper segments 102, 104 thereto. This can be accomplished with the web 100 moving at a constant speed and the periphery of first and second rotary drums 102, 104 moving at a constant rotational speed (as measured in distance per unit time rather than radians per unit time) or circumferential speed equal to the constant speed of the web at least during the sealing process but possibly throughout the entire rotation (with an intermittent pause in the rotation to allow the loading of the zipper segment in the rotation position illustrated by second rotary drum 12 in FIG. 1). Zipper segments 102 (placed by first rotary drum 12) and zipper segments 104 (placed by second rotary drum 14) alternate with each other along the length of web 100. CPU 200 includes programming (along with necessary memory, storage and information input, such as speed of the web 100) to synchronize the rotation, timing and functions of first and second rotary drums 12, 14, first and second zipper sources 20, 22, and associated functions in order to provide the desired (typically constant distance) spacing between the successive zipper segments. Web 100 with the zipper segments 102, 104 sealed thereto is provided to subsequent manufacturing steps for a reclosable package or bag, typically a form-fill-and-seal process.

First and second rotary drums 12, 14 are illustrated as being one half the width of the web 100 and centrally located thereon. However, the first and second rotary drums 12, 14 could be the entire width of the web 100 with the zipper segments 102, 104 centrally located therein.

Figure 3:
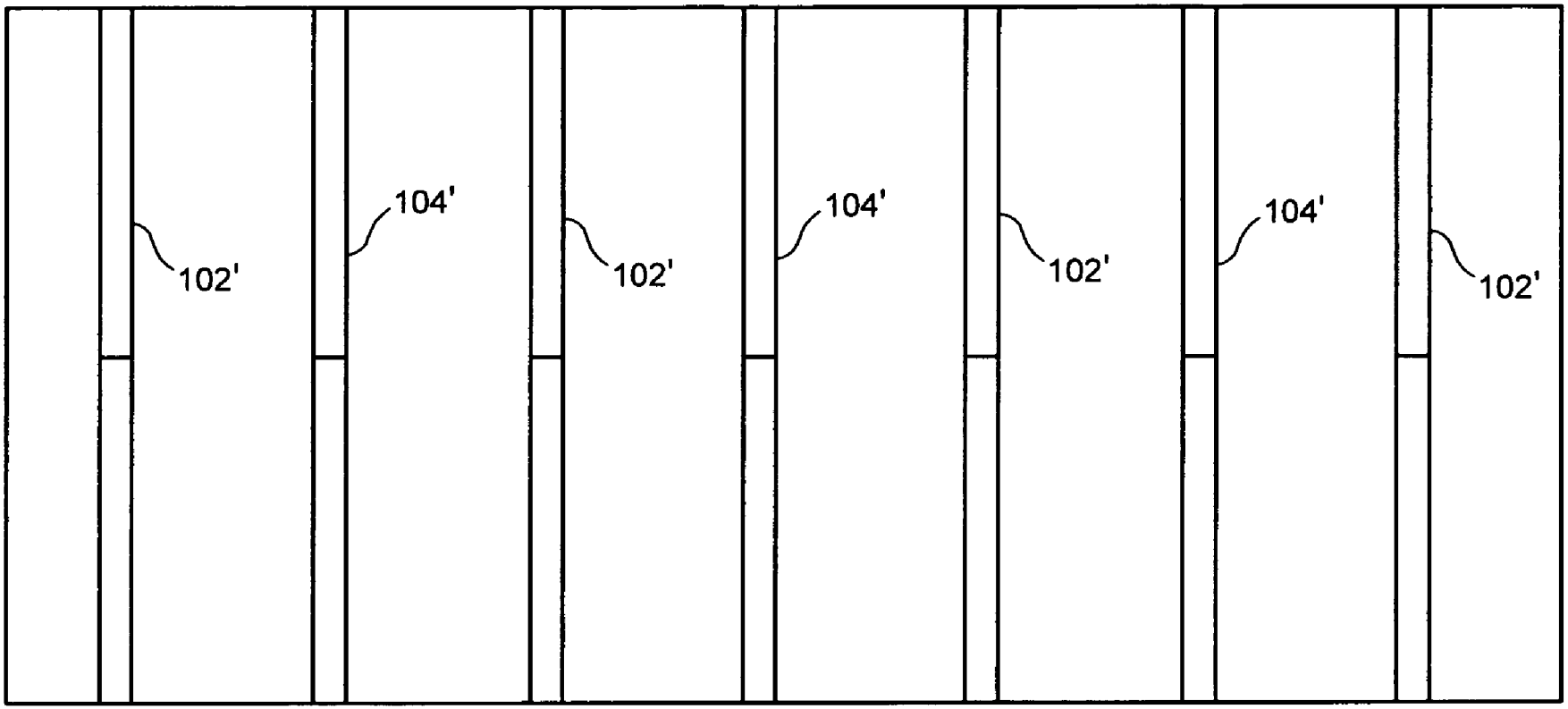
FIG. 3 is a top plan view of the resultant web configuration after full width drums are used to apply double zipper segments.

As it is envisioned that first and second rotary drums 12, 14 have a periphery which has a circumferential rotational speed substantially equal to the linear speed of the web 100, it can be seen that rotary drums 12, 14 are illustrated with an enlarged circumference with respect to the spacing of the zipper segments 102, 104 on web 100 (that is, in the case of constant rotational speed equal to the linear speed of the web, the distance between a zipper segment 102 and the immediately adjacent zipper segment 104 as measured in the machine direction will be one half of the circumference of the rotary drums 12, 14). Additionally, while zipper notches 16, 18 are illustrated at respective uppermost and lowermost rotational positions, there is likely to be some further phase shift introduced in order to compensate for the machine direction distance between the rotational axes of first and second rotary drums 12, 14. Similarly, the illustrated embodiment of rotary drum configuration 10 includes zipper segments 102, 104 which are substantially one half the width of the web 100. It is envisioned that the lateral edges of web 100 would eventually brought together and sealed over the zipper segments to form the second wall of a reclosable package or bag (not shown). However, of course, rotary drum configuration 10 is equally applicable to other proportions of zipper segment length to web width (such as, but not limited to, providing zipper segments across the entire width of the web, with the second wall of the subsequent reclosable package being supplied by a separate source of web of equal width thereby providing the possibility of using double zipper segments 102', 104' for subsequent production of two packages or bags at a time as shown in FIG. 3).

An alternative use for the disclosed rotary drum configuration 10 is to load different types of zipper into first and second zipper sources 20, 22 in order to use only one of the first and second zipper sources 20, 22 for a given production run and allow a quick conversion or change-over between the two.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. An apparatus for sealing zipper segments to a moving web, comprising:

a first rotary drum for receiving first zipper segments and sealing the first zipper segments to the moving web;

a second rotary drum for receiving second zipper segments and sealing the second zipper segments to the moving web; and wherein the first zipper segments alternate with the second zipper segments on the moving web.

2. The apparatus of claim 1 wherein the first and second rotary drums are oriented to seal the first and second zipper segments in an orientation transverse to the moving direction of the web.

3. The apparatus of claim 2 further include control means for controlling the first and second rotary drums to seal the first and second zipper segments at pre-selected intervals on the web.

4. The apparatus of claim 3 wherein the pre-selected intervals are constant distances.

5. The apparatus of claim 4 wherein the first and second rotary drums receive respective first and second zipper segments from respective first and second zipper sources.

6. The apparatus of claim 5 wherein the web is moved at a constant speed during operation of the first and second rotary drums.

7. The apparatus of claim 6 wherein the first and second rotary drums have a periphery which rotates at a circumferential speed equal to the constant speed of the web.

8. The apparatus of claim 6 wherein the first and second rotary drums have a periphery which rotates at a circumferential speed equal to the constant speed of the web after receiving the respective first and second zipper segment and sealing the respective first and second zipper segment to the web.

9. The apparatus of claim 6 wherein the first and second rotary drums have a periphery which rotates at a constant circumferential speed throughout entire revolutions equal to the constant speed of the web.

10. The apparatus of claim 1 wherein the first and second zipper segments include respective first and second sliders mounted thereon.

11. The apparatus of claim 1 wherein the first and second zipper segments extend across an entire width of the moving web.

12. The apparatus of claim 11 wherein the first and second zipper segments are double zipper segments.

13. The apparatus of claim 1 wherein the first and second rotary drums extend across half the width of the moving web.

14. The apparatus of claim 1 wherein the first and second rotary drums extend across a centrally located half of the moving web.

15. The apparatus of claim 1 wherein the first and second rotary drums stop for loading the respective first and second zipper segments, then rotate at a circumferential speed equal to a speed of the moving web, and seal the respective first and second zipper segments to the moving film.

16. The apparatus of claim 15 wherein the first drum is stopped for loading the first zipper segment during at least a portion of a time period that the second drum is rotating.

17. The apparatus of claim 16 wherein the second drum is stopped for loading the second zipper segment during at least a portion of a time period that the first drum is rotating.

18. The apparatus of claim 1 wherein the first and second zipper segments are cut to length from respective first and second continuous lengths of zipper prior to being loaded into the respective first and second rotary drums.

19. The apparatus of claim 1 wherein the first and second zipper segments are directed into respective first and second notches of the respective first and second rotary drums.

* * * * *